United States Patent [19]

Nishioka

[11] Patent Number: 4,776,754

[45] Date of Patent: Oct. 11, 1988

[54] TOTAL FLOW TURBINE

[75] Inventor: Ryozo Nishioka, Yokohama, Japan

[73] Assignee: Fuji Electric Co., Ltd., Kawasaki, Japan

[21] Appl. No.: 899,213

[22] Filed: Aug. 21, 1986

[30] Foreign Application Priority Data

Aug. 29, 1985 [JP] Japan ..... 60-190368

[51] Int. Cl.[4] ..... F01D 1/20; F01D 11/04

[52] U.S. Cl. ..... 415/80; 415/172 A; 415/175; 415/121 A; 60/657

[58] Field of Search ..... 415/110, 111, 112, 114, 415/115, 116, 117, 121 A, 168, 169 R, 169 A, 172 A, 175, 176, 180, 202, 199.4, 199.5, 80; 60/653, 657

[56] References Cited

U.S. PATENT DOCUMENTS

| | | | |
|---|---|---|---|
| 3,372,906 | 3/1968 | Griffith | 415/80 |
| 3,831,381 | 8/1974 | Swearingen | 60/657 |
| 3,884,041 | 5/1975 | Zerlauth | 60/657 |
| 3,906,730 | 9/1975 | Bellati et al. | 60/657 |
| 3,926,010 | 12/1975 | Eskeli | 415/114 X |
| 4,057,362 | 11/1977 | Schwaebel | 415/172 A X |
| 4,227,373 | 10/1980 | Amend et al. | 415/121 A X |
| 4,495,035 | 1/1985 | Swearingen | 415/168 X |

FOREIGN PATENT DOCUMENTS

| | | | |
|---|---|---|---|
| 1576965 | 6/1970 | Fed. Rep. of Germany | 415/80 |
| 9889 | of 1908 | United Kingdom | 415/199.5 |
| 9367 | of 1908 | United Kingdom | 415/199.5 |

*Primary Examiner*—Robert E. Garrett
*Assistant Examiner*—Joseph M. Pitko
*Attorney, Agent, or Firm*—Brumbaugh, Graves, Donohue & Raymond

[57] ABSTRACT

Hot water is uniformly accelerated in a nozzle having a tapered flow passage so that it can flow into a moving blade smoothly. The hot water is then expanded and accelerated within the flow passage of the moving blade which is not turned but widened toward its end and power is generated by its reaction, thereby ensuring a highly efficient total flow turbine.

8 Claims, 2 Drawing Sheets

TOTAL FLOW TURBINE

BACKGROUND OF THE INVENTION

The present invention relates to a total flow turbine which utilizes expanded hot water to generate power.

The present inventor has proposed a total flow turbine in which hot water is partially expanded and accelerated in a nozzle (Japanese patent application No. 195377).

In such a total flow turbine, when the pressure differential or pressure ratio which represents the difference between the pressure of the hot water before it reaches the nozzle and the pressure thereof after it has passed through the nozzle is small, the two-phase flow of hot water and steam suffers from the following problems at the outlet of the nozzle.

(1) Flushing (evaporation) of hot water is delayed within the nozzle.

(2) The size of water droplets in the nozzle has a wide scatter band. As a result, the flow speed of water droplets in the nozzle also has a wide scatter band.

(3) Water droplets are not easily made fine.

The lower the pressure of the hot water, the more such tendencies prevail. As the flow of hot water becomes uneven at the outlet of the nozzle, i.e., as the size and flow speed of water droplets vary, the flow speed and flow angle of water droplets relative to the inlet of the moving blade also vary greatly, causing the water droplets to collide with the leading edge of the moving blade and thereby result in additional loss.

SUMMARY OF THE INVENTION

An object of the present invention is to provide a total flow turbine which is capable of reducing such a loss and is improved in its efficiency, i.e., which is capable of reducing the loss caused by collision of water droplets at the inlet of the moving blade by making the flow of water as even as possible at the outlet of the nozzle.

As described above, when the pressure ratio is small, i.e., when there is a small thermal head of the hot water which passes through the nozzle, if the hot water is expanded and flushed within the nozzle, it is very difficult to provide a flow of uniform and fine water droplets at the outlet of the nozzle. To solve this problem, in the present invention, the hot water is put in a saturated or slightly supercooled state before it passes through the nozzle, and is then accelerated within the nozzle but not flushed, thereby ensuring a uniform flow of hot water at the outlet of the nozzle and eliminating the additional loss caused by the collision of water droplets at the inlet of the moving blade. For this purpose, the flow passage of the nozzle is narrowed toward the outlet so that hot water is throttled and accelerated but not flushed within the nozzle, while the flow passage in the moving blade is widened toward the outlet so that hot water is expanded, flushed and thereby accelerated within the moving blade.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
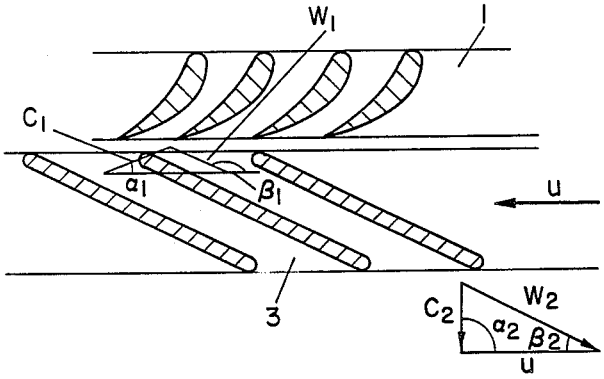
FIG. 1*a* is the development of a cylindrical cross-section through a turbine stage pursuant to the present invention.
FIG. 1*b* is a longitudinal section of the turbine stage in FIG. 1*a;*
Figure 1:
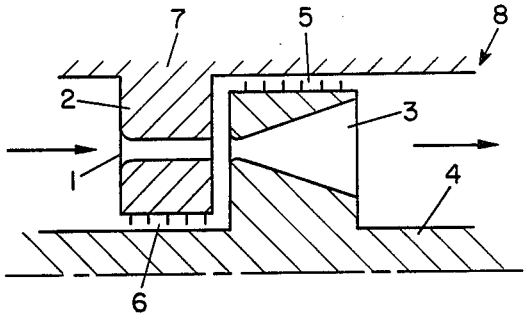

FIGS. 1(*a*) and (*b*) illustrate the principle of a high reaction type flow turbine according to the present invention, wherein FIG. 1(*a*) is a section taken along the pitch circle and FIG. 1(*b*) is a section taken along the axis of the turbine. Reference numeral 1 denotes a nozzle provided in a nozzle holder 2; 3 denotes a moving blade which faces the nozzle 1; 4 denotes a rotor integrally formed with the moving blade 3; and 5 and 6 denote labyrinth packings provided between the moving blade 3 and a casing 7 and the nozzle holder 2 and the rotor 4, respectively. The total flow turbine of the present invention differs from the turbine disclosed in the prior art in that the flow passage of the nozzle 1 is narrowed toward the outlet while that of the moving blade 3 is widened toward the end.

It has been confirmed through experiments that even if the hot water is put into a saturated state before it passes through the nozzle, it is not generally flushed in the flow passage which extends ahead of the nozzle throat, and can remain in a supersaturated state at the throat.

Figure 2:
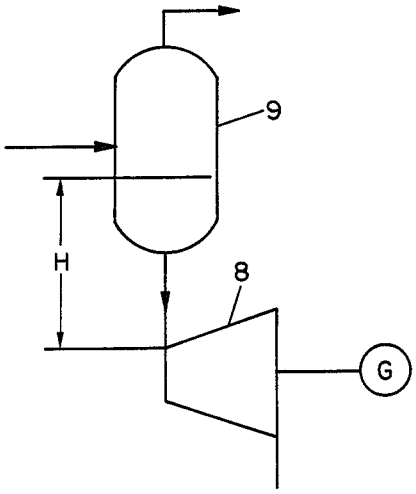
FIG. 2 schematically illustrates how the steam pressure is raised before reaching the nozzle.
Figure 3:
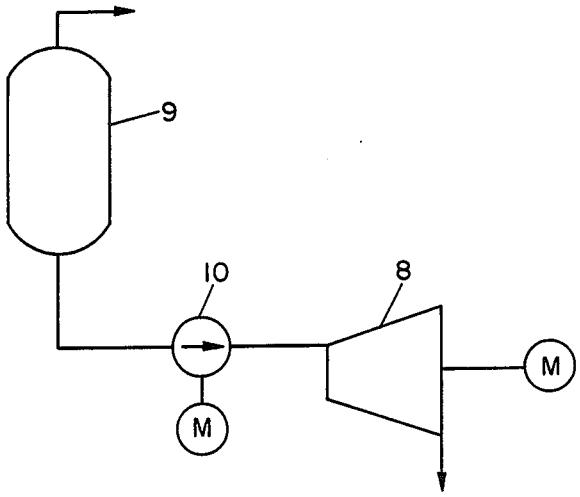
FIG. 3 illustrates an alternative embodiment for raising steam pressure.

To assure the acceleration of hot water without flushing within the nozzle, hot water is pressurized to a desired supercooled state at the nozzle inlet. For this purpose, the steam separator 9 is mounted with a desirable head H over the total flow turbine 8 as shown in FIG. 2, or a booster pump 10 is adopted between the steam separator 9 and the total flow turbine 8 as shown in FIG. 3.

In such a case, it is possible to select the degree of supercooling of hot water at the inlet of the total flow turbine so that hot water flows into the moving blade in a just saturated state after it is accelerated through the nozzle.

To prevent hot water from flushing before it flows into the moving blade, it is important to reduce leakage flow through the labyrinth packing portions 5 and 6 at the outer end of the moving blade row and the shaft sealing portion.

Figure 4:
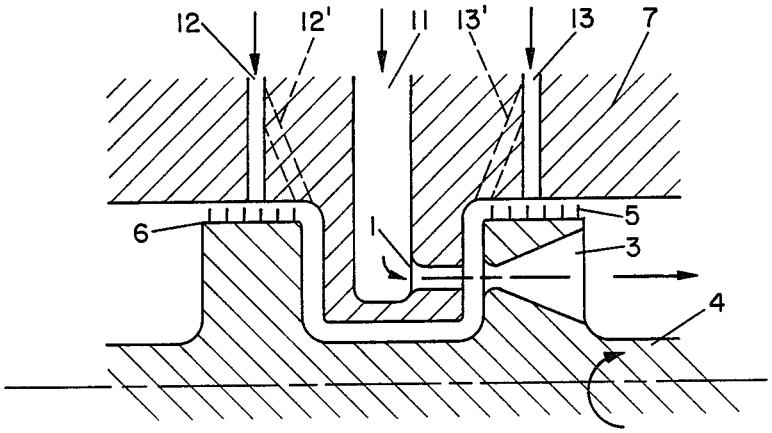
FIG. 4 illustrates an embodiment of the present invention for reducing leakage.

FIG. 4 shows an example of a method of solving this problem in which leakage loss is reduced by introducing from the steam separator 9, which is mounted ahead of the total flow turbine 8, steam having a far larger specific volume than that of the hot water. A hot water inlet 11 is connected to the nozzle holder 2, and, for this purpose, sealing steam inlets 12 and 13 are provided at the labyrinth packings 5 and 6 of the casing 7.

In this arrangement, hot water can be kept saturated at the outlet of the nozzle 1, i.e., at the inlet of the moving blade 3, by directly introducing through sealing steam inlets 12' and 13' saturated steam from the steam separator 9 into the space between the nozzle 1 and the moving blade 3.

Figure 5:
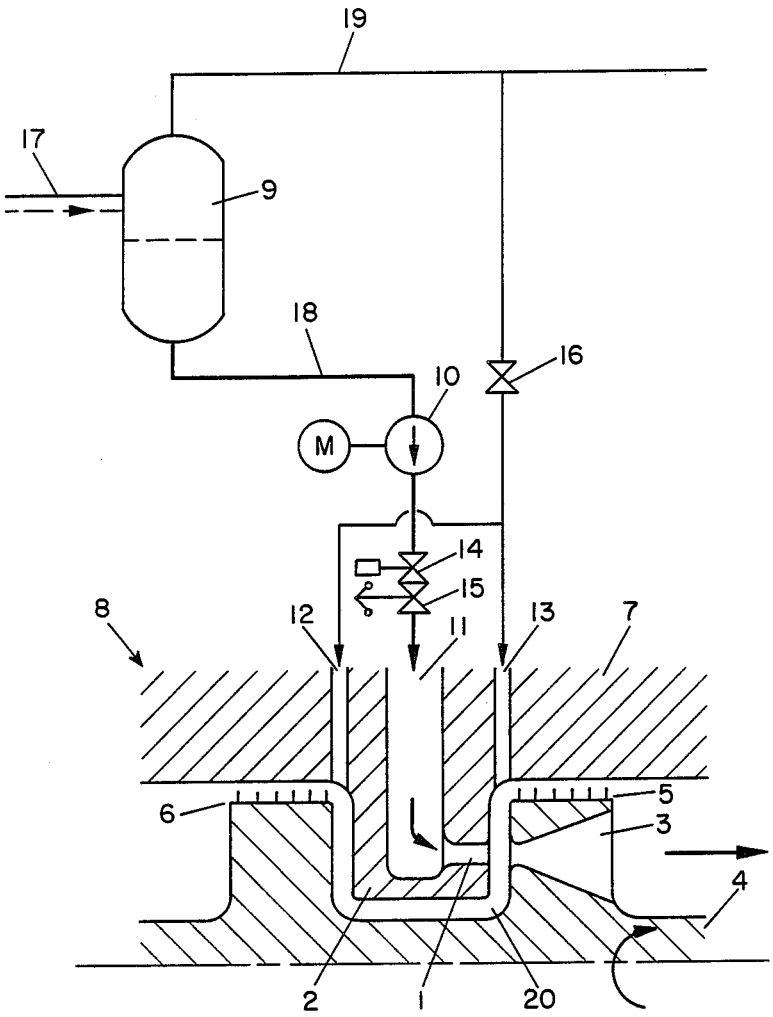
FIG. 5 shows an embodiment of the high reaction type flow turbine according to the present invention.

FIG. 5 shows an embodiment of the total flow turbine according to the present invention which is based on the principle described above. In this Figure, reference numeral 1 denotes a nozzle; 2 denotes a nozzle holder; 3 denotes a moving blade; 4 denotes a rotor; 5 denotes a labyrinth packing; 6 denotes a labyrinth packing (for thrust balance piston); 7 denotes a casing; 8 denotes a total flow turbine; 9 denotes a steam separator; 10 denotes a booster pump; 11 denotes a hot water inlet; and 12 and 13 denote sealing steam inlets. These parts correspond to those in the previous description, and a detailed explanation thereof is omitted. The total flow turbine of this embodiment further includes an emergency stop valve 14 and a governing valve 15 which are disposed between the booster pump 10 and the hot water inlet 11. A regulator valve 16 is also provided between the steam separator 9 and the sealing steam inlets 12 and 13.

In this embodiment, a mixed two-phase fluid 17 of hot water and steam is first divided into hot water and steam (containing non-condensed gas) in the steam separator 9. After the pressure thereof has been raised by the booster pump 10, hot water 18 is introduced in a supercooled state through the emergency stop valve 14 and the governing valve 15 from the hot water inlet 11 into the nozzle 1 of the total flow turbine 8. Part of steam 19 is introduced in a saturated state to a steam chest 20 located beyond the nozzle 1 through the regulator valve 16 to be used as sealing steam. The pressure of the hot water is reduced down to saturation pressure and the speed thereof is increased while it passes through the nozzle 1 before flowing into the moving blade 3. In the moving blade 3, the pressure of the hot water is reduced, and the hot water is flushed, expanded and accelerated so that the rotor is rotated by its reaction.

Figure 6:
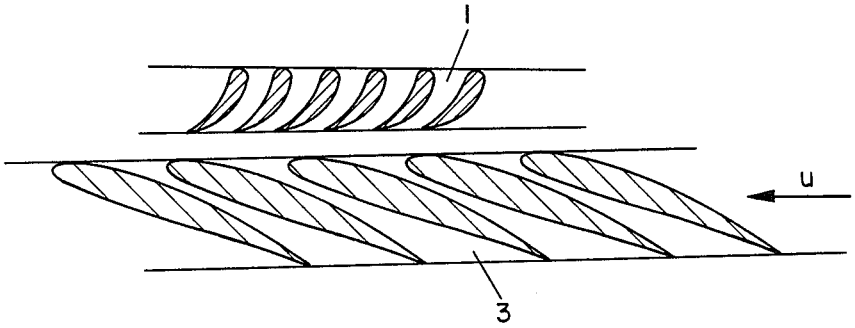
FIG. 6 is a cross-sectional view of a nozzle and a moving blade employed in the embodiment of the present invention.

FIG. 6 is a cross-sectional view of the nozzle 1 and the moving blade 3 employed in the present invention, in which the nozzle 1 is formed with a flow passage narrowed toward the outlet and the moving bladed 3 is formed with a flow passage widened toward the outlet.

Figure 7:
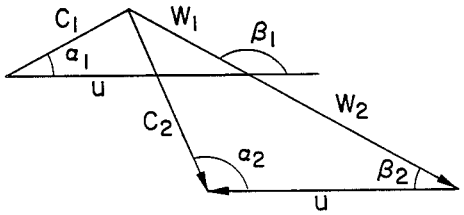
FIG. 7 shows an example of velocity triangles according to the structure shown in FIG. 6.

FIG. 7 shows velocity triangles created by the nozzle 1 and the moving blade 3 employed in the present invention, where the symbols c1, c2, w1, w2, u, $\alpha 1$, $\beta 1$, and $\alpha 2$ and $\beta 2$ respectively represent the nozzle outlet velocity, the moving blade outlet velocity, the moving blade inlet relative velocity, the moving blade outlet relative velocity, the peripheral speed, the nozzle outlet angle, the moving blade relative inlet angle, the moving blade outlet angle and the moving blade relative outlet angle.

With the above-described arrangement, the hot water is uniformly accelerated and is caused to flow into the moving blade 3 smoothly due to the fact that the nozzle 1 has a tapered flow passage. The hot water is then expanded and accelerated within the flow passage of the moving blade 3 which is widened toward its outlet but not deflected and power is generated by its reaction, thereby ensuring a highly efficient total flow turbine.

The total flow turbine of this embodiment employs water and steam as its working medium. The present invention may also apply to a total flow turbine which uses another medium such as Freon or ammonia.

As will be understood from the foregoing description, the hot water employed in the present invention is uniformly accelerated in a nozzle having a tapered flow passage so that it can flow into a moving blade smoothly. The hot water is then expanded and accelerated within the flow passage of the moving blade which is not turned but widened toward its end and power is generated by its reaction, thereby ensuring a highly efficient total flow turbine.

While the invention has been illustrated and described as embodied in a total flow turbine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A total flow turbine with a high degree of reaction, comprising: a nozzle defining a flow passage formed so as to narrow toward an outlet of said flow passage, said nozzle being provided so as to accelerate hot water used as a turbine working fluid; and a moving blade row provided so as to receive the accelerated hot water from said nozzle, said moving bladed row defining a flow passage formed so as to be as straight as possible and to widen toward its outlet so that the hot water flow is expandable and acceleratable therein; the degree of said narrowing selected so as to keep the hot water from flushing prior to its exit from the outlet of the nozzle.

2. A total flow turbine as defined in claim 1, wherein said nozzle has a hot water inlet, and further comprising supercooling means for inducing in the hot water a pressure higher than the saturation pressure for water at that temperature.

3. A total flow turbine as defined in claim 2, wherein the supercooling means further comprises a steam separator provided ahead of and at a height higher than the turbine.

4. A total flow turbine as defined in claim 2, further comprising a booster pump provided ahead of said total flow turbine, so as to obtain a desired pressure rise in the hot water flow.

5. A total flow turbine as defined in claim 1; and further comprising a rotor, and a casing provided so as to define labyrinth portions between said moving blade row and said casing, and between said rotor and said casing, one of steam, a mixed gas of steam and noncondensed gas which is separted by a steam separator provided ahead of the total flow turbine, or steam from a separate steam source having a pressure at least as high as the pressure of the steam and the mixed gas from said steam separator being introducable into said labyrinth portions so as to provide sealing for the total flow turbine.

6. A total flow turbine as defined in claim 1; and further comprising a steam space provided between said nozzle and said moving blade row, one of steam, a mixed gas of steam and non-condensed gas which is separated by a steam separator provided ahead of the total flow turbine , or steam from a separated steam source having a pressure at least as high as the pressure of the steam and mixed gas from the steam separator, being introducable into said steam space so as to provide sealing for the total flow turbine.

7. A total flow turbine, comprising: a nozzle defining a flow passage formed so as to narrow toward an outlet of said flow passage, said nozzle being provided so as to accelerate hot water used as a turbine working fluid; and a moving blade row provided so as to receive the accelerated hot water from said nozzle, said moving blade row defining a flow passage formed so as to be as straight as possible and to widen toward its outlet so that the hot water flow is expandable and acceleratable therein; and further comprising a rotor, and a casing provided so as to define labyrinth portions between said moving blade row and said casing, and between said rotor and said casing, one of steam, a mixed gas of steam and non-condensed gas which is separated by a steam separator provided ahead of the total flow turbine, or steam from a separate steam source having a pressure at least as high as the pressure of the steam and the mixed gas from said steam separator being introducable into said labyrinth portions so as to provide sealing for the total flow turbine.

8. A total flow turbine, comprising: a nozzle defining a flow passage formed so as to narrow toward an outlet of said flow passage, said nozzle being provided so as to accelerate hot water used as a turbine working fluid; and a moving blade row provided so as to receive the accelerated hot water from said nozzle, said moving blade row defining a flow passage formed so as to be as straight as possible and to widen toward its outlet so that the hot water flow is expandable and acceleratable therein; and further comprising a steam space provided between said nozzle and said moving blade row, one of steam, a mixed gas of steam and non-condensed gas which is separated by a steam separator provided ahead of the total flow turbine, or steam from a separate steam source having a pressure at least as high as the pressure of the steam and mixed gas from the steam separator, being introducible into said steam space so as to provide sealing for the total flow turbine.

* * * * *